US005274935A

United States Patent [19]

Frenette

[11] Patent Number: 5,274,935

[45] Date of Patent: Jan. 4, 1994

[54] COPYHOLDER WITH MECHANIZED LINE GUIDE

[76] Inventor: Albert E. Frenette, 14 Tate St., Hudson, N.H. 03051

[21] Appl. No.: 994,785

[22] Filed: Dec. 22, 1992

[51] Int. Cl.[5] ..... B41J 11/64

[52] U.S. Cl. ..... 40/356; 248/441.1

[58] Field of Search ..... 40/356, 352, 353, 359; 248/441.1, 442.2

[56] References Cited

U.S. PATENT DOCUMENTS

| | | | |
|---|---|---|---|
| 1,540,342 | 6/1925 | Stauder | 40/356 |
| 1,612,192 | 12/1926 | Johnson | 248/441.1 X |
| 2,523,755 | 9/1950 | Ford | 40/356 |
| 3,030,924 | 4/1962 | Hansen | 40/356 |
| 3,126,648 | 3/1964 | Strong | 40/356 |
| 3,332,399 | 7/1967 | Patrick | 248/441.1 |
| 3,449,850 | 6/1969 | Eckert | 40/356 |
| 4,195,429 | 4/1980 | Wegner | 40/356 |
| 4,433,499 | 2/1984 | Sharber | 40/356 |
| 4,760,661 | 8/1988 | Yoshikoshi | 40/356 |
| 5,185,947 | 2/1993 | Thompson | 40/359 |

FOREIGN PATENT DOCUMENTS

| | | | |
|---|---|---|---|
| 1124056 | 2/1962 | Fed. Rep. of Germany | 248/441.1 |
| 1086525 | 2/1955 | France | 248/441.1 |

*Primary Examiner*—J. Franklin Foss

*Attorney, Agent, or Firm*—Davis, Bujold & Streck

[57] ABSTRACT

The present invention provides a copyholder having a ratchet mechanism including a flexible rack attached to a line guide with the rack being operable by a pawl which is moved by a foot operated actuator functioning through a cable to move the line guide in discrete steps the magnitude of which are adjustable. Manual adjustment of the line guide is permitted when the ratchet mechanism is in an inoperative position.

6 Claims, 2 Drawing Sheets

COPYHOLDER WITH MECHANIZED LINE GUIDE

The present invention relates to a copyholder with a manually overridable mechanized line guide.

BACKGROUND OF THE INVENTION

Copyholders in which line guides are manually moveable to highlight a particular line of text are numerous and widely used. Such copyholders require an interruption in a copy typing operation while the line guide is adjusted to the next one or more lines of text to be copied. Such activities are a waste of time in an office environment.

SUMMARY OF THE INVENTION

It is an object of the present invention to provide a mechanized line feed for a copyholder which is reliable, entirely mechanical and economical in materials utilized and in the cost of production.

According to the invention there is provided a mechanized copyholder comprising a) a document holder having a face for supporting a document; b) a line guide extending at least partly across said face for alignment with text of such a document, the line guide being supported by said holder for guided movement over said face normal to the extension of said guide across said face; c) a ratchet mechanism operably connected to said line guide to provide said guided movement of said line guide in discrete steps; and d) means for operating said ratchet mechanism to provide said discrete steps of guided movement.

BRIEF DESCRIPTION OF THE DRAWINGS

The invention will now be described, by way of example, with reference to the accompanying drawings, in which.

DETAILED DESCRIPTION OF THE PREFERRED EMBODIMENT

Figure 1:
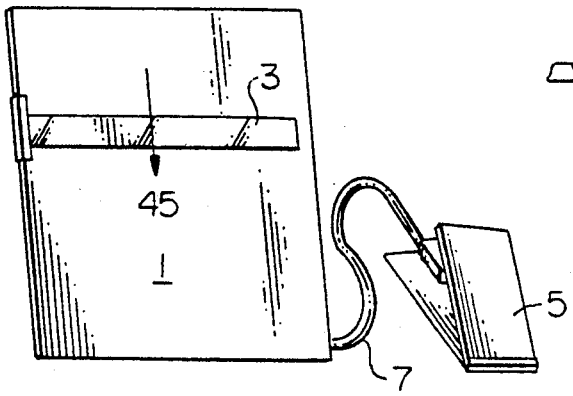
FIG. 1 is a diagrammatic view of the mechanized copyholder of the present invention.

The copyholder of the present invention is illustrated generally in FIG. 1 wherein a document holder 1 guides a line guide 3 for vertical movement over the face of the document holder for the desired indication of lines of text carried on a document supported by the holder. A foot operated actuator 5 is connected to the document holder 1 by a cable 7.

Figure 3:
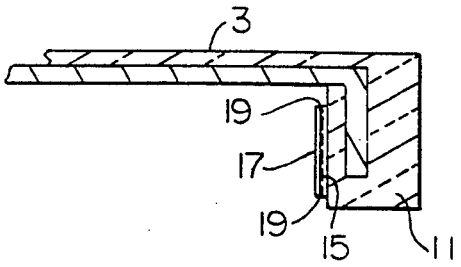
FIG. 3 is a diagrammatic cross-section on section line 3—3 of FIG. 2.
Figure 2:
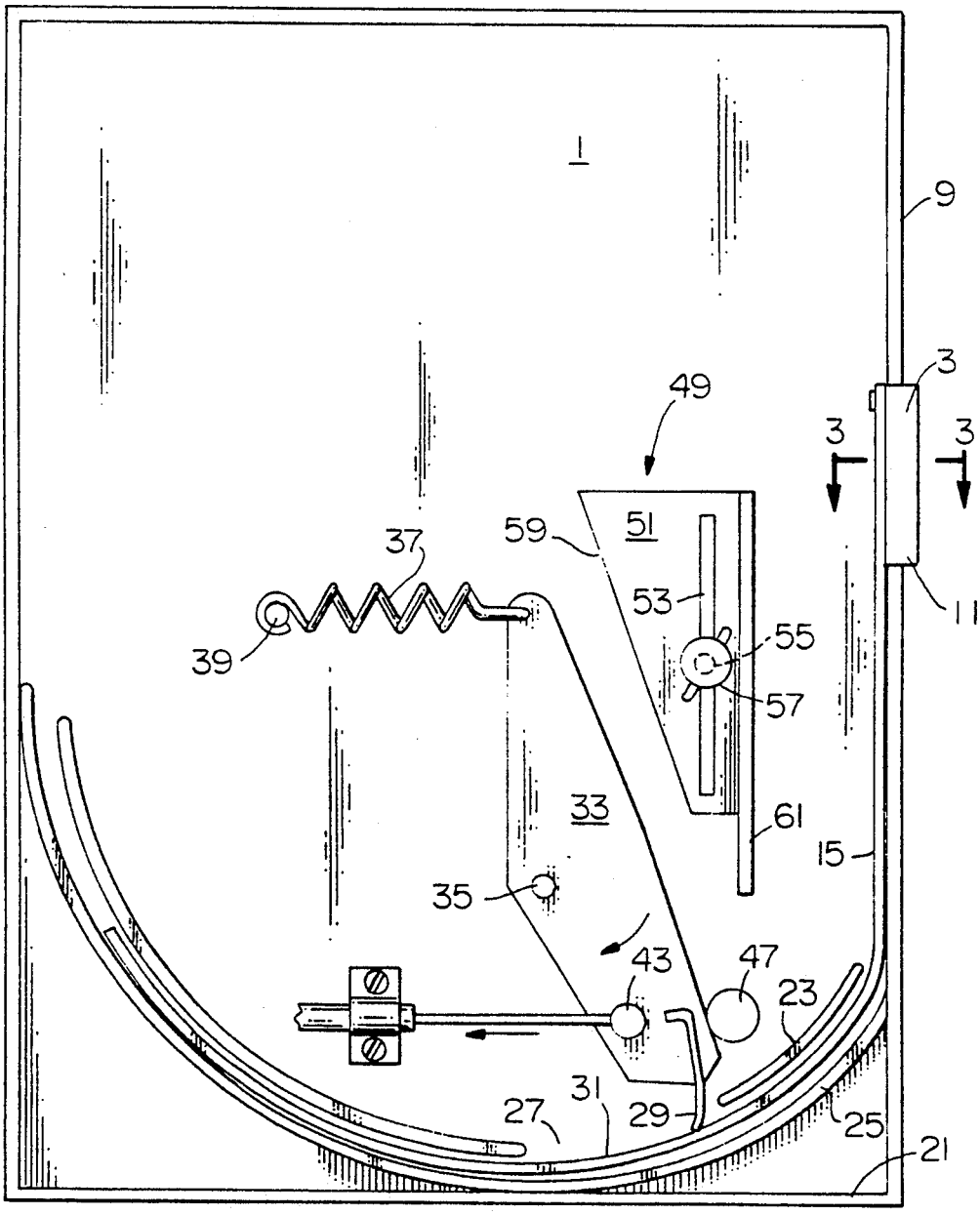
FIG. 2 is a diagrammatic rear view of the document holder portion of the copyholder shown in FIG. 1 illustrating the mechanism housed within that document holder.
Figure 4:
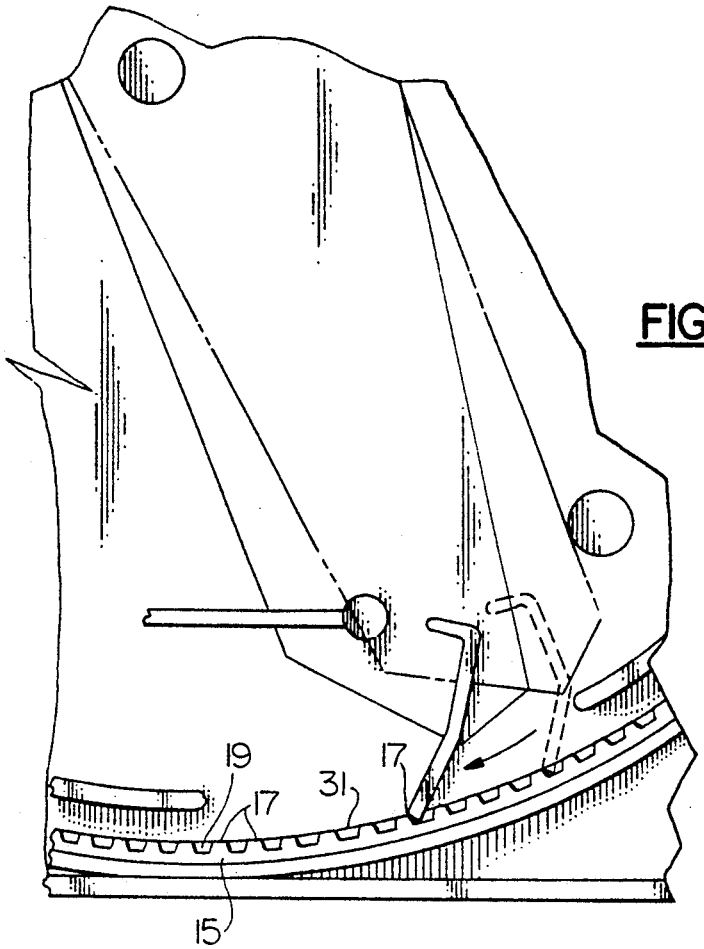
FIG. 4 is an enlarged portion of the view illustrated in FIG. 2 showing greater detail of the ratchet mechanism of the preferred embodiment of the present invention.

Referring more specifically to FIGS. 2, 3 and 4, the rear of the document holder 1 defines a lip 9 extending along one edge of the holder to guide the line guide 3 by means of a line guide edge support 11 held captive by the lip 9 for sliding a movement along the lip 9 to move the line guide 3 up and down the document holder 1. Attached to the edge support 11 by a screw 13 is a flexible rack 15 which carries an evenly spaced plurality of transverse teeth 17 extending between edge ridges 19 of the rack. The rack 19 may conveniently be a portion of a cable tie commonly used to clamp electrical cables into bundles with the teeth engaging a buckle which in the present application is removed. Adjacent the bottom 21, the rack is guided between curved guide members 23 and 25. The inner member 23 defines an opening 27 providing access of a pawl 29 of the ratchet mechanism of the present invention, of which the pawl 29 and rack 15 constitute the operational parts, to the toothed surface of the rack which faces inwardly from the outer edges of the document holder 1.

The pawl 29 is a spring member fixedly supported by an operating arm 33 which is pivotable about a pivot pin 35, rigidly attached to the document holder 1, under the biasing influence of a tension spring 37 extending from the operating arm 33 to a spring support pin 39, also rigidly attached to the document holder 1. The wire inner 41 of the cable 7 is attached to the operating arm 33 by a nipple 43 which is firmly attached to the end of the wire inner 41 and which is located within an opening in the operating arm 33 at a location at which a pull on the wire inner 41 will pivot the operating arm 33 against the tension of the spring 37 to move the pawl 29 into engagement with a tooth of the rack 15 to move that rack in the direction of movement of the pawl thereby to move line guide 3 downwardly over the face of the document holder in the direction of the arrow 45 in FIG. 1.

The sheath of the cable 7 through which the wire inner passes is clamped to the document holder 1 by a bracket 46 to facilitate operation of the cable by the foot operated actuator 5.

The operating arm 33 is illustrated in FIG. 2 in its inoperative position in which it is held against a stop 47 firmly attached to the document holder 1, with the pawl 29 out of engagement with the rack 15 so that the line guide may be manually slid up and down the lip 9, if desired, to a desired location on the face of the document holder 1.

The frictional engagement of the line guide with the lip 9 of the rack 15 and with the guides 25 and 23, particularly 23, serves to provide sufficient friction for the line guide to remain in place except when it is moved manually or upon operation of the operating arm 33 to bring the pawl 29 into engagement with the teeth of the rack 15.

FIG. 4 shows, in ghost, the position of the operating arm 33 and pawl 29 in their rest position and, in full lines, the engagement of the pawl 29 with a tooth 17 of the rack 15 upon pivotal movement of the operating arm 33 about the pivot pin 35 under the influence of the cable 7 to move the operating arm 33 away from the stop 47, with the consequent movement of the rack 15 to move the line guide 3 downwardly over the face of the document holder 1.

A stroke limiter 49 adjustably limits the pivotable movement of the operating arm 33 to limit the movement of the rack 15, and consequently the downward movement of the line guide 3 during each individual pivotable motion of the operating arm under the influence of the cable 7 as a result of operation of the foot operated actuator 5. The stroke limiter 49 comprises a slotted plate 51 defining a vertical slot 53 through which a pin 55, firmly attached to the document holder, passes to a wing nut 57 by which the slotted plate may be clamped in a desired position in which its tapered edge 59 is located to provide a desired limitation on the pivotable movement of the operating arm 33. The body plate 51 is maintained in its vertical orientation by a guide bar 61 which is firmly attached to the document holder 1 at a location to control the orientation of the slotted plate 51.

Figure 6:
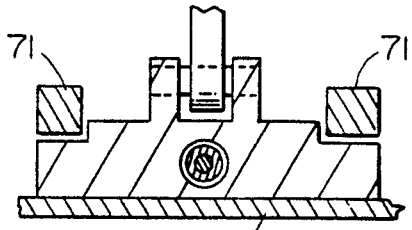
FIG. 6 is a diagrammatic cross-section on section line 6—6 of FIG. 5.
Figure 5:
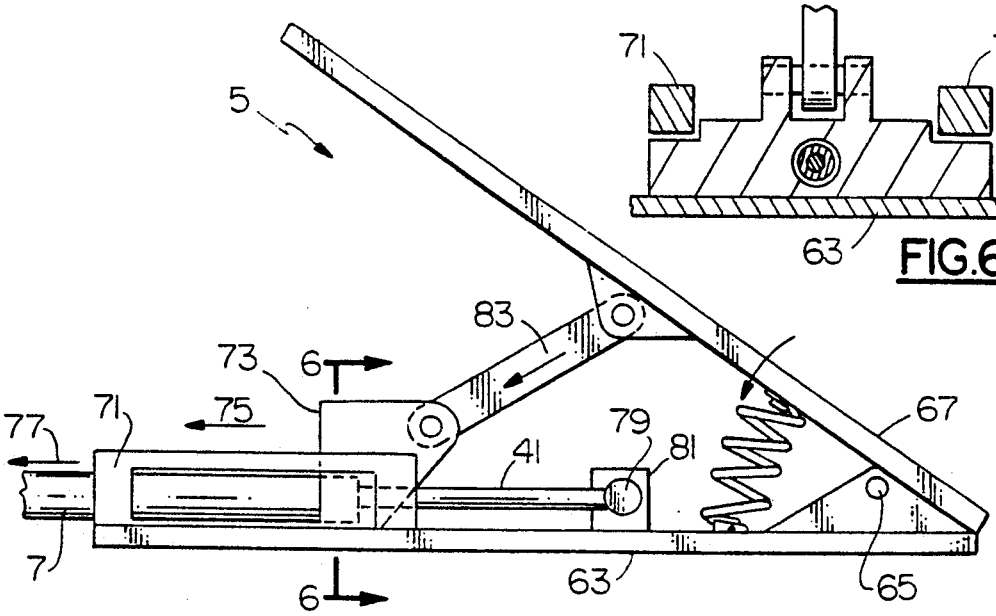
FIG. 5 is a diagrammatic side elevation of a foot operated actuator operable to actuate the mechanism of the document holder, illustrated in FIGS. 3 and 4, by way of a cable.

Referring now to FIGS. 5 and 6, the foot operated actuator 5 comprises a base plate 63 which pivotably supports, by a pivot pin 65, a pivotable foot operated plate 67 which is biased away from the base plate 63 by a compression spring 69 located by location bosses on the face plate and foot operated plate respectively.

Remote from the pivot pin 65 the base plate 63 carries a parallel cable operating member guides 71 which guides cable operating member 73 for longitudinal movement away from the pivot pin 65 in the direction of arrow 75 to move the cable sheath of the cable 7 in the direction of arrow 77. The wire inner 41 is prevented from movement by a nipple 79 which is firmly attached to the wire inner 41 at the foot operator actuator 5 the nipple being restrained by being housed in an opening of a bracket 81 attached to the base plate 63.

A push rod 83 is pivoted to the cable operating member 73 and to a pivot attachment on the foot operated plate 67 so that pressure on the foot operated plate 67 relative to the base plate 63 against the pressure exerted by the spring 69 will slide the sheath of the cable 7 over the wire inner 41 with the consequent movement of the wire inner 41 into the sheath of the cable 7, at the mechanism of the document holder 1, to pivot the operating arm 33 against the biasing force of the spring 37 to operate the pawl and ratchet mechanism.

Following depression of the foot plate 67 against the spring 69, relaxation of that operating pressure allows the spring 69 to return the foot operated plate to the orientation shown in FIG. 5 ready for a further operating stroke. The stroke limiter 49 is adjusted to the desired downward movement of the line guide for each stroke of the foot operator actuator 5.

It is to be appreciated that the ratch mechanism and the means for operating said ratch mechanism may comprise a solenoid electrically coupled to a switch. The switch may be incorporated into the foot operated actuator or another device located remote from the copyholder each actuation of the solenoid providing a discrete step of the guided movement over said face normal to the extension of said guide.

It will be appreciated that the mechanism may be varied without departing from the inventive concept, including variations in the placement of various components at different locations and in different functional orders.

I claim:

1. A mechanized copyholder comprising:

a) a document holder having a face for supporting a document;

b) a line guide extending at least partly across said face for alignment with text of such a document, the line guide being supported by said holder for guided movement over said face normal to the extension of said guide across said face;

c) a ratchet mechanism operably connected to said line guide to provide said guided movement of said line guide in discrete steps;

d) means for operating said rachet mechanism to provide said discrete steps of guided movement; and e) wherein said ratchet mechanism is supported by said document holder and comprises an elongate flexible rack, defining a plurality of evenly spaced transverse teeth, attached to the line guide, and a pawl supported for movement by said operating means to move said rack longitudinally to provide said guided movement.

2. A mechanized copyholder according to claim 1 wherein when the operating means is inoperative the pawl occupies an inoperative position in which the pawl is spaced from the rack thereby permitting manual adjustment of the position of the line guide.

3. A mechanized copyholder according to claim 2 wherein the pawl is supported and operated by an operating arm pivoted to said holder for pivotal movement between said inoperative position, to which the arm is biased by spring means, and an operative position in which the pawl engages the rack to provide said guided movement, the pivotal movement being provided by the operating means by way of a cable and the spring means.

4. A mechanized copyholder according to claim 3 comprising adjustable stop means adjustably attached to the document holder to limit the movement of the rack by each operation of the operating means to provide desired said discrete steps.

5. A mechanized copyholder according to claim 1 wherein the operating means is a foot operable actuator operatively connected to the ratchet mechanism to provide a said discrete step for each operation of the actuator by way of a cable interconnecting the actuator and the ratchet mechanism.

6. A mechanized copyholder according to claim 1 comprising curved guide means for guiding the rack during said guided movement of the line guide and for locating the rack for engagement by the pawl upon operation of the operating means.

* * * * *